US012781993B2

(12) United States Patent
Moloney

(10) Patent No.: US 12,781,993 B2
(45) Date of Patent: Nov. 3, 2026

(54) HVAC SYSTEM AIR INTAKE MANAGER AND METHOD OF USING THE SAME

(71) Applicant: Patrick D. Moloney, New Bern, NC (US)

(72) Inventor: Patrick D. Moloney, New Bern, NC (US)

( * ) Notice: Subject to any disclaimer, the term of this patent is extended or adjusted under 35 U.S.C. 154(b) by 0 days.

(21) Appl. No.: 18/774,043

(22) Filed: Jul. 16, 2024

(65) Prior Publication Data

US 2024/0377097 A1 Nov. 14, 2024

Related U.S. Application Data

(63) Continuation of application No. 17/082,685, filed on Oct. 28, 2020, now Pat. No. 12,092,357.

(60) Provisional application No. 62/937,527, filed on Nov. 19, 2019.

(51) Int. Cl.

| | |
|---|---|
| ***F24F 13/06*** | (2006.01) |
| ***F24F 13/02*** | (2006.01) |
| ***F24F 13/14*** | (2006.01) |

(52) U.S. Cl.

CPC ..... *F24F 13/06* (2013.01); *F24F 13/0209* (2013.01); *F24F 13/1486* (2013.01); *F24F 2013/0616* (2013.01)

(58) Field of Classification Search

CPC .... F24F 13/06; F24F 13/0209; F24F 13/1486; F24F 2013/0616; F24F 13/04

See application file for complete search history.

(56) References Cited

U.S. PATENT DOCUMENTS

| | | | | |
|---|---|---|---|---|
| 1,825,423 | A * | 9/1931 | Rottinghaus | F24F 13/06 454/284 |
| 3,308,746 | A * | 3/1967 | Weiss | F24F 13/075 454/307 |
| 3,552,294 | A | 1/1971 | Goldberg | |
| 4,693,175 | A | 9/1987 | Hashimoto | |
| 4,850,266 | A * | 7/1989 | Bennett | F24F 13/0227 454/284 |
| 6,065,296 | A | 5/2000 | Feger | |
| 9,657,962 | B2 | 5/2017 | Mosley | |
| 2013/0281000 | A1* | 10/2013 | Newcomer | F24F 7/08 454/237 |
| 2015/0241082 | A1* | 8/2015 | Mosley | F24F 7/04 454/290 |

OTHER PUBLICATIONS

"Rectangular Ducts". Arabian International Co. for Steel Structures (AIC Steel).Jul. 24, 2019. p. 26. (http://www.aicsteel.com/wp-content/uploads/2019/09/Rectangular-Catalog.pdf) (Year: 2019).

* cited by examiner

*Primary Examiner* — Michael G Hoang
*Assistant Examiner* — Brett P. Mallon
(74) *Attorney, Agent, or Firm* — Ward and Smith, P.A.; Ryan K. Simmons

(57) ABSTRACT

A method of using an apparatus for managing return air intake in a heating, ventilation, and air conditioning (HVAC) system. The may include providing, providing an apparatus for managing return air intake in a HVAC system; positioning the air intake management apparatus in the space to be serviced by the HVAC system such that the return air outlet is in fluid communication with the existing return air vent of the HVAC system; and activating the HVAC system.

8 Claims, 15 Drawing Sheets

HVAC SYSTEM AIR INTAKE MANAGER AND METHOD OF USING THE SAME

RELATED APPLICATIONS

This application is a continuation patent application of U.S. patent application Ser. No. 17/082,685, filed Oct. 28, 2020, the application of which claims priority to U.S. Patent Application No. 62/937,527, filed Nov. 19, 2019 the entire disclosures of which are incorporated herein by reference.

TECHNICAL FIELD

The subject matter of the present invention relates generally to air-based heating, ventilation, and air conditioning (HVAC) systems and more particularly to a forced air HVAC system air intake manager and method of using same.

BACKGROUND

HVAC systems are commonly used to provide ventilation and air filtration, and control thermal comfort and indoor air quality in residential and commercial structures, such as homes and office buildings. An HVAC system's ability to satisfactorily provide these benefits may depend on temperature of air being pulled in at the air return versus the temperature of the air in other parts of the room. If the air in a room being cooled or heated is stratified, it can result in inefficiencies in the system which can result in increased energy consumption, increased operational costs, and decreased life of the HVAC system, in addition to providing less comfortable heating and cooling.

Methods and components commonly used for HVAC system delivery and return air pathways have some disadvantages. For example, not enough care is given to the locations of the air delivery and return air vents and consequently the HVAC system does not allow for optimal operating efficiency. Specifically, the optimal placement of heating vs. cooling vents is different. The placement of return air vents, especially, can affect performance. Therefore, new approaches are needed for ensuring efficient operation of HVAC systems.

SUMMARY

In one embodiment, an apparatus for managing air intake in a heating, ventilation, and air conditioning (HVAC) system is provided. The apparatus may include a substantially hollow airflow body; at least one air inlet formed in a first portion of the airflow body; and an air outlet formed in a second portion of the airflow body, wherein at least one air inlet and the air outlet are in fluid communication through at least a portion of the airflow body. The air outlet may be configured to engage in fluid communication with a return air vent of an HVAC system. The apparatus may further include one or more adaptors configured to allow the air outlet to engage in fluid communication with a return air vent of an HVAC system. At least one air inlet may be disposed in one of an upper portion or lower portion of the airflow body. The air outlet may be disposed in one of an upper portion or lower portion of the airflow body. The air inlet may be disposed in a first end portion of the airflow body and the air outlet may be disposed in an opposite second end portion. A first air inlet may be configured to intake air from an upper region of a space being serviced by the HVAC system and a second air inlet may be configured to intake air from a lower region of the space being serviced by the HVAC system. One airflow body may include two air inlets, wherein a first one of the two air inlets may be formed in an upper portion of the airflow body and a second one of the two inlets may be formed in a lower portion of the airflow body. The air outlet may be formed in the lower portion of the airflow body in a sidewall different than that of a sidewall that the second one of the two inlets is formed in. The first and second air inlets may be in selective fluid communication with the air outlet. The apparatus may further include a closure mechanism, wherein the closure mechanism may be positionable and configured to selectively block fluid communication between one of the first or second air inlets and the air outlet. The position of the closure mechanism may be set manually to block fluid communication between one of a selected one of the first or second air inlets and the air outlet. The position of the closure mechanism may be set automatically, based on a state of operation of the HVAC system, to block fluid communication between a selected one of the first or second air inlets and the air outlet. The closure mechanism may be hingedly connected to an interior portion of the airflow body. The airflow body may include a plurality of stackable sections. The airflow body may include one or more of a rigid, semi-rigid, flexible, and collapsible material. The airflow body may include one of a rectangular, ovular, or circular cross-sectional shape. The airflow body may be configured to be portable.

In another embodiment, a method of using an air intake manager is provided. The method may include providing an air intake management apparatus. The air intake management apparatus may include a substantially hollow airflow body; at least one air inlet formed in a first portion of the airflow body; and an air outlet formed in a second portion of the airflow body, wherein the at least one air inlet and the air outlet are in fluid communication through at least a portion of the airflow body. The method may further include positioning the air intake management apparatus in a space to be serviced by an HVAC system such that the air outlet is in fluid communication with a return air vent of an HVAC system; and activating the HVAC system.

In another embodiment, an HVAC air intake management system is provided. The air intake management system may include an air distribution body. The air distribution body may include a first air input port; a second air input port; and an air return outlet port, wherein the air return outlet port is in selective fluid communication with the first air input port and the second air input port, and in fluid communication with an HVAC air return duct. The HVAC air intake management system may further include an upper return air vent in fluid communication with the first air input port; a lower return air vent in fluid communication with the second air input port; a closure mechanism configured to selectively close one of the first air input port or the second air input port; and wherein, the air return outlet port is configured to return air pulled from one of the upper return air vent or the lower return air vent via a selectively open one of the first air input port or second air input port to the HVAC air return duct.

BRIEF DESCRIPTION OF THE DRAWINGS

Figure 6A:
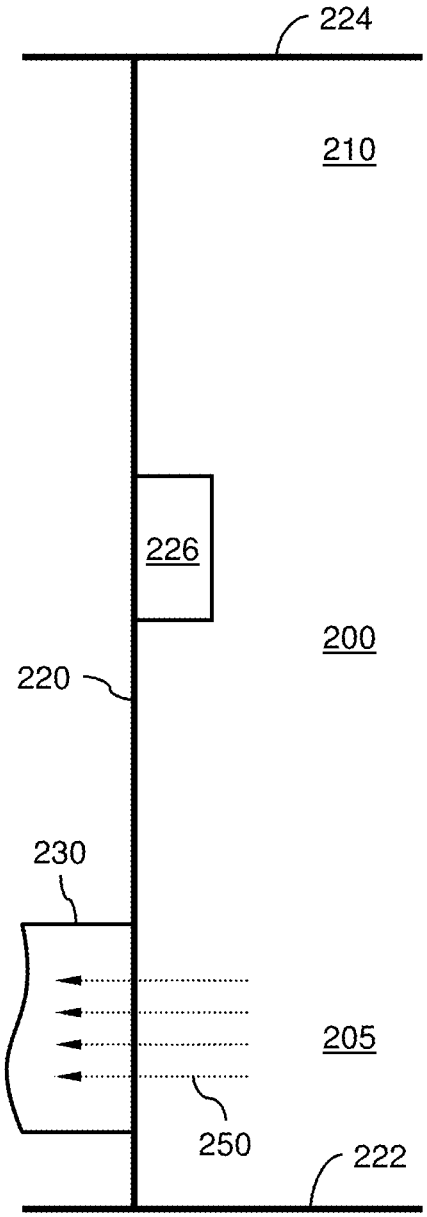
Figure 6B:
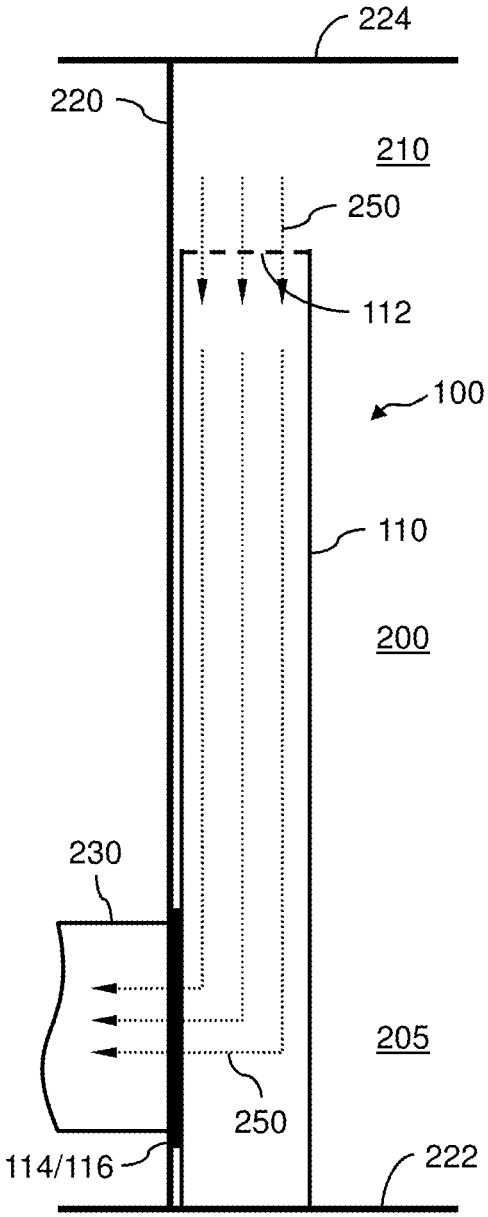
Figure 7A:
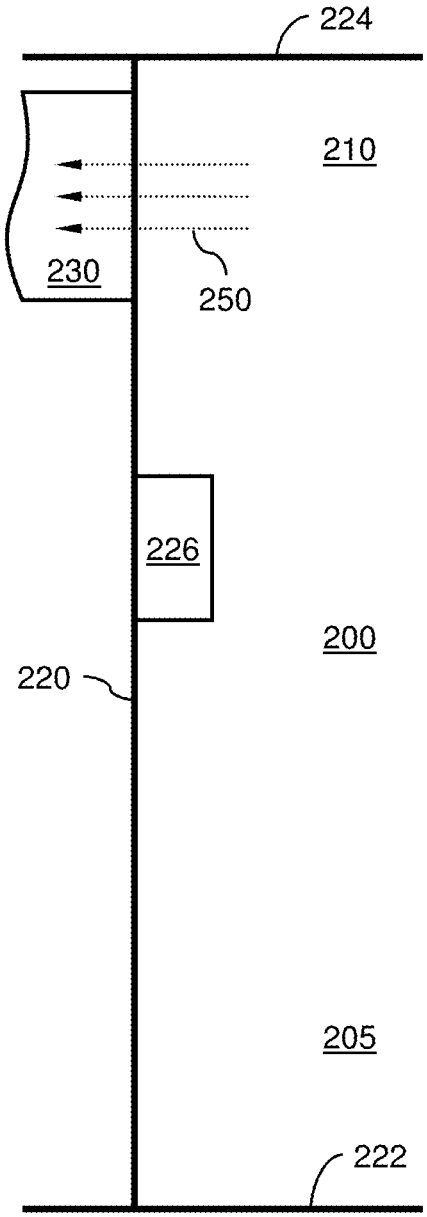
Figure 7B:
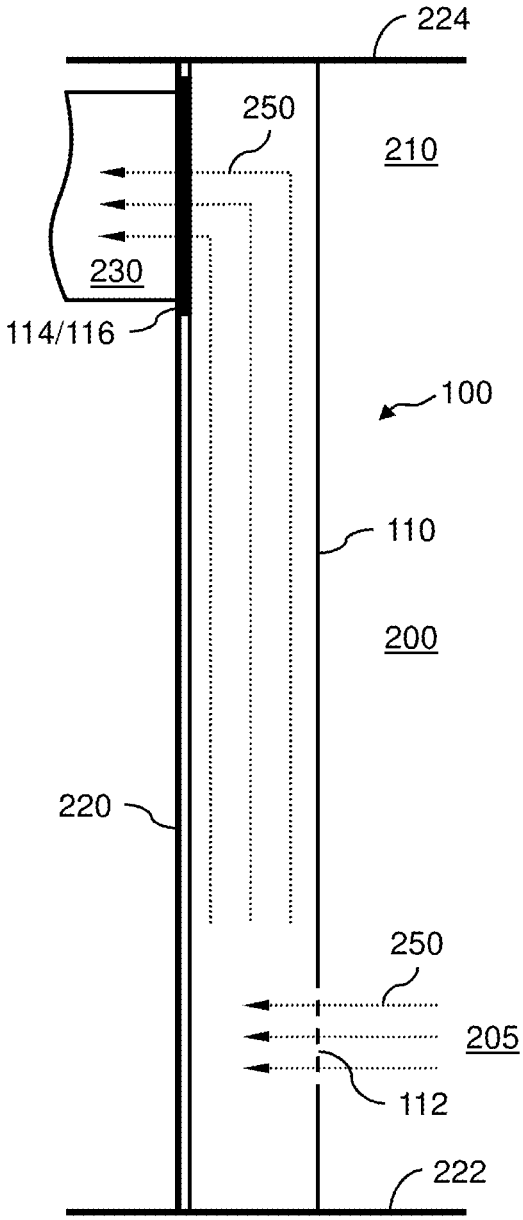
Figure 8A:
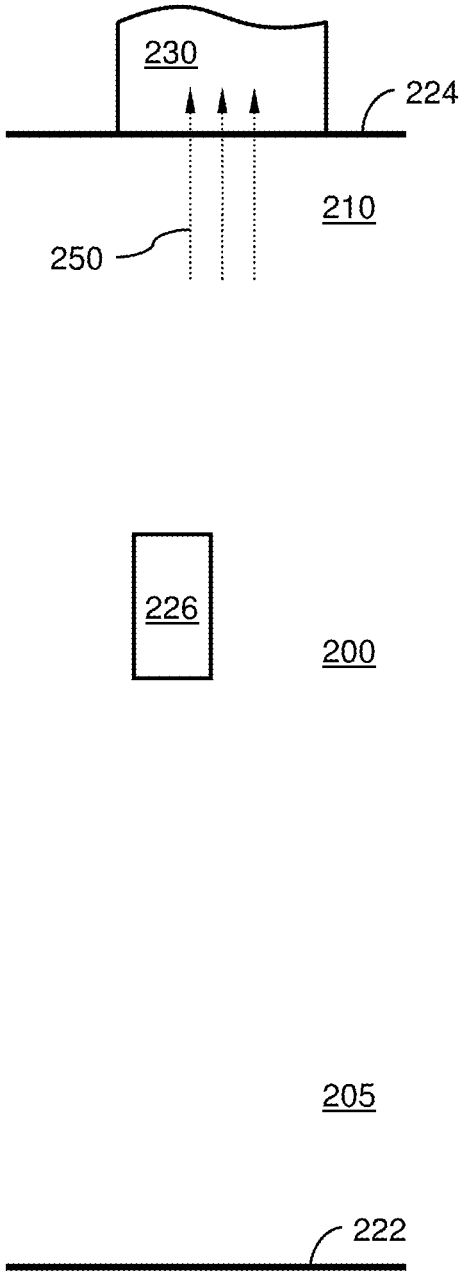
Figure 8B:
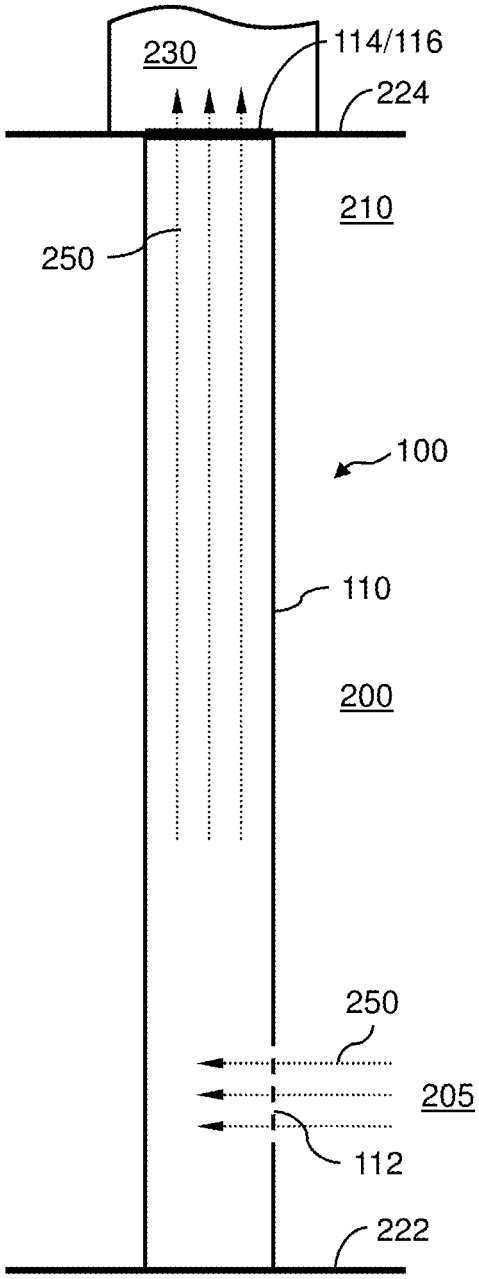
Figure 8C:
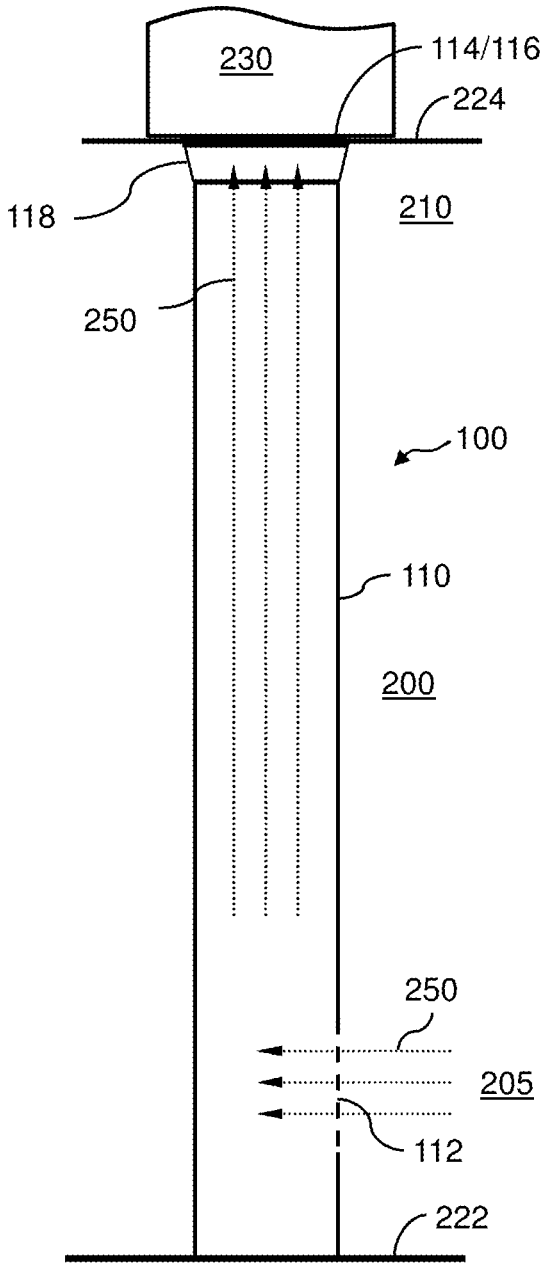
Figure 9A:
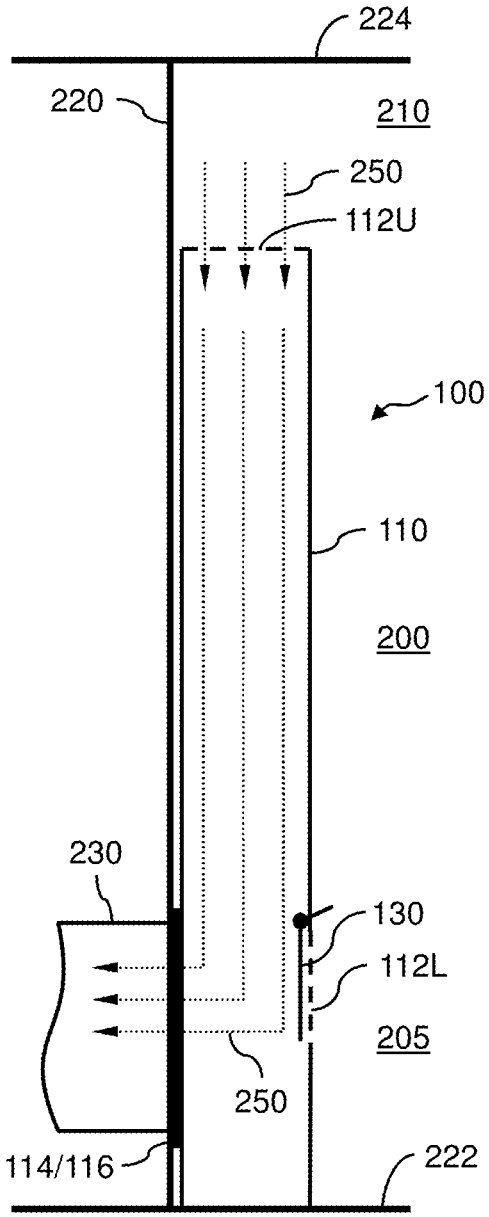
Figure 9B:
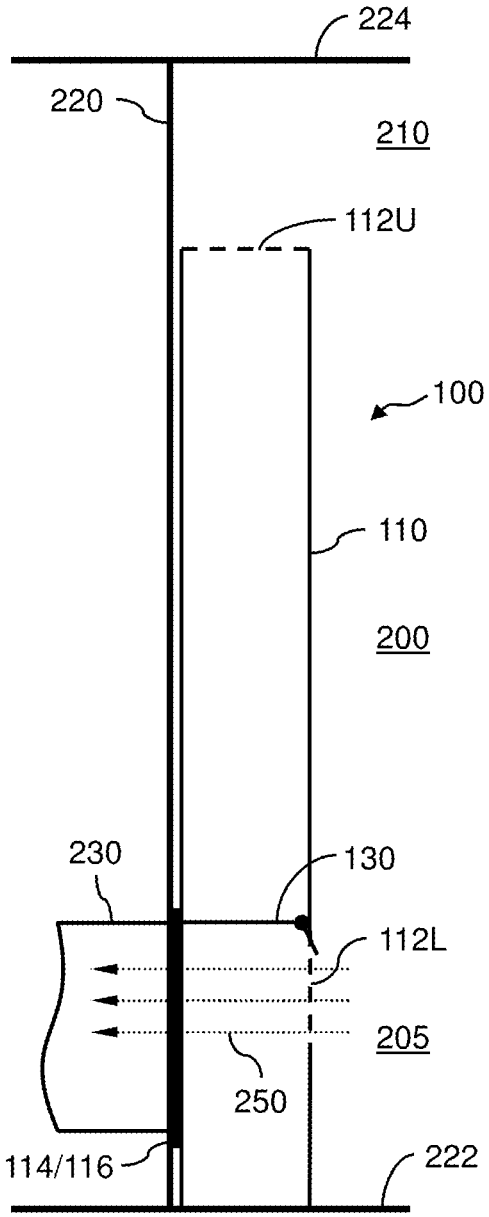
Figure 10A:
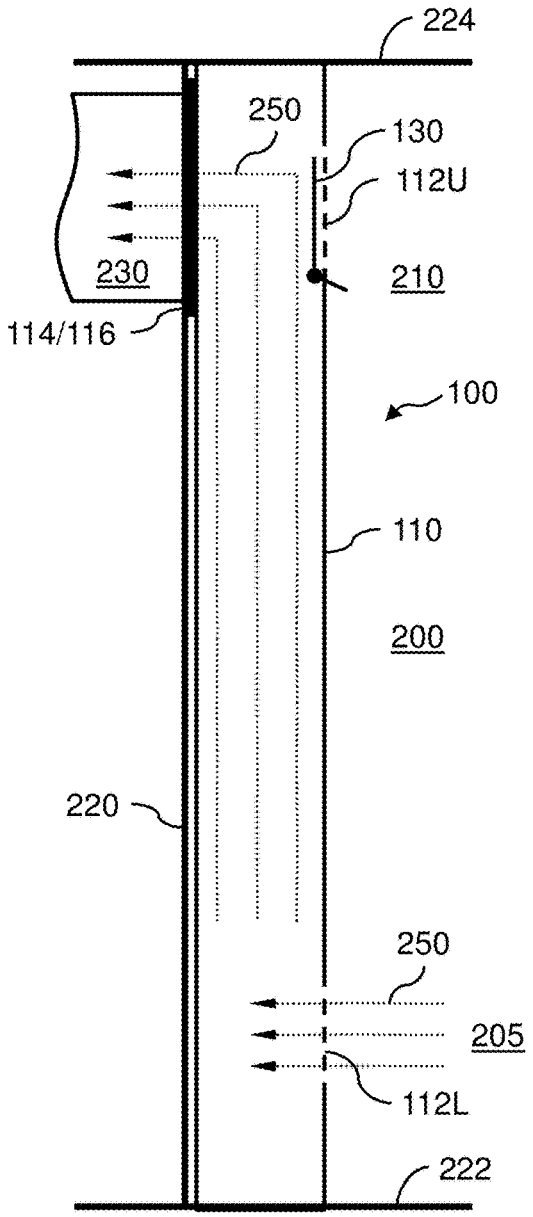
Figure 10B:
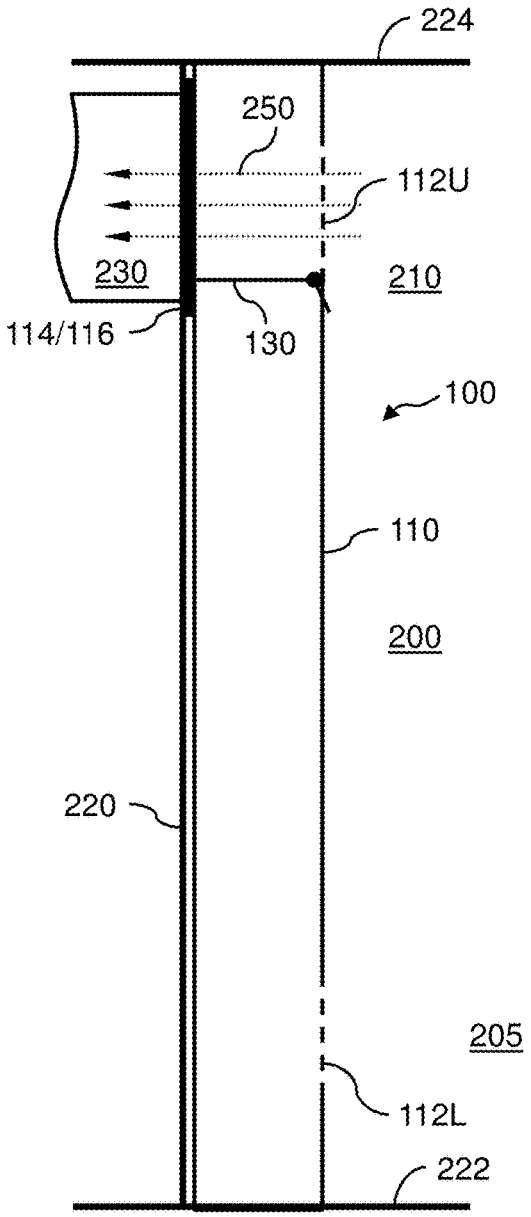
Figure 11A:
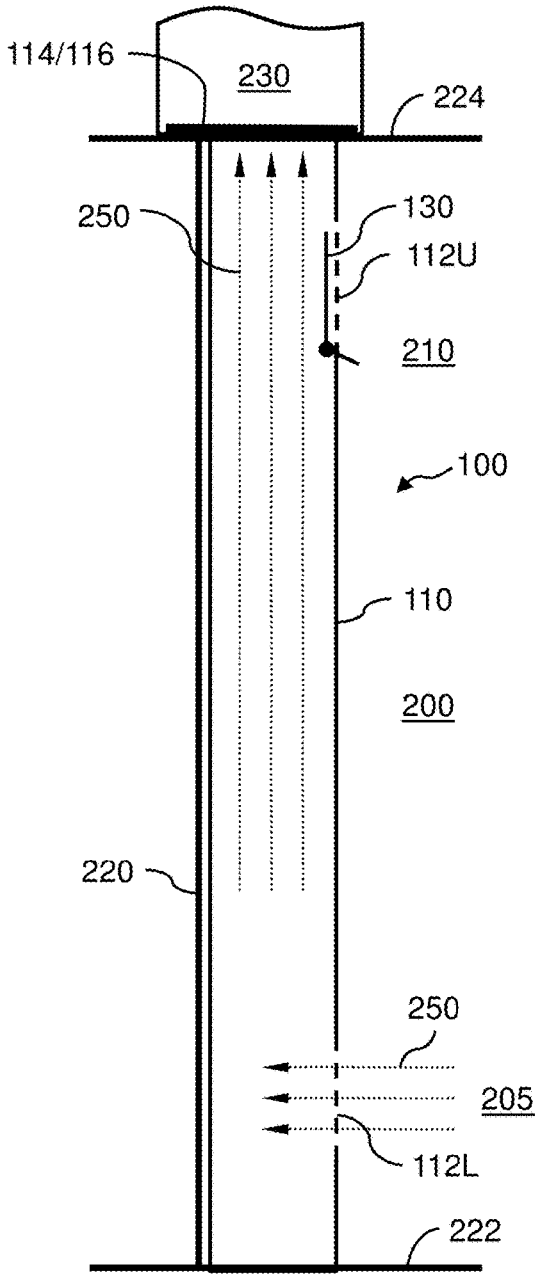
Figure 11B:
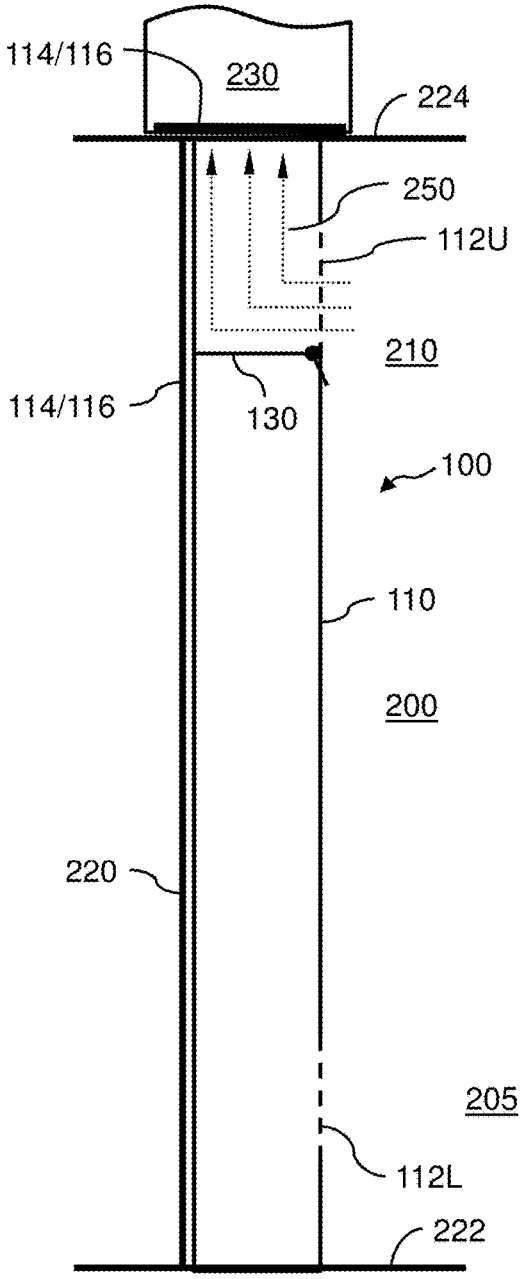
Figure 12:
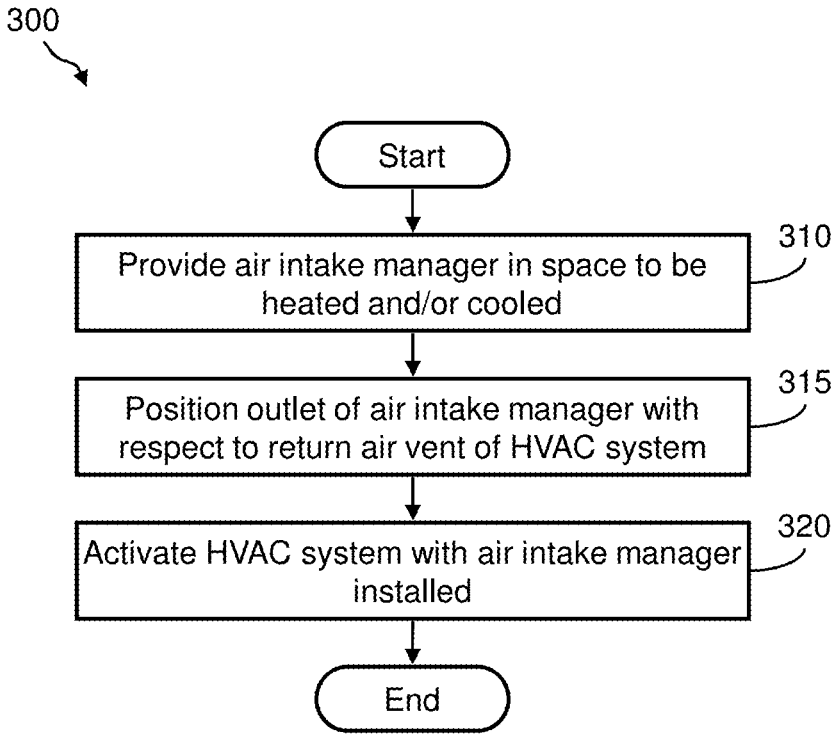
Figure 13A:
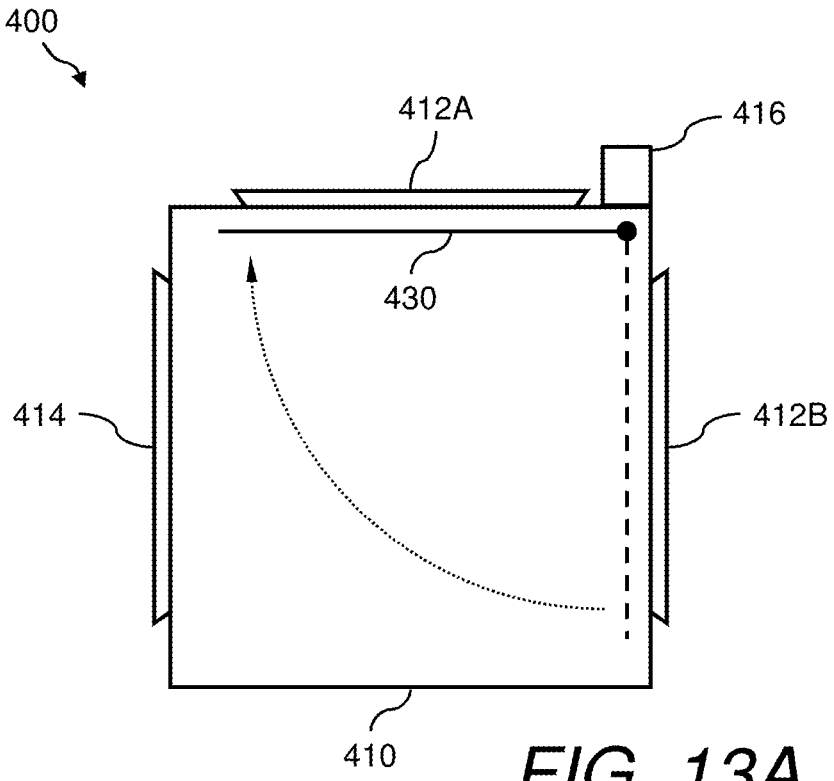
Figure 13B:
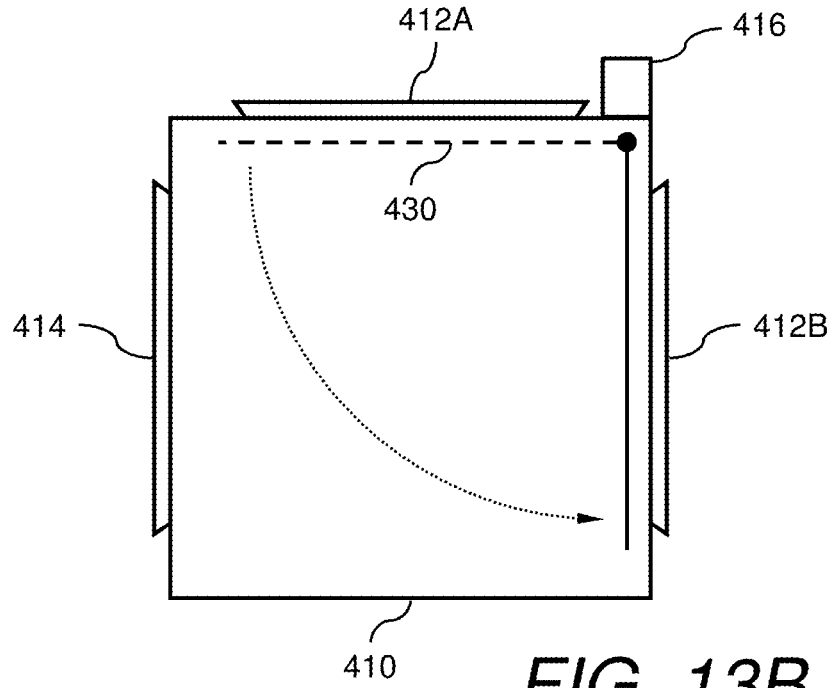
Figure 14A:
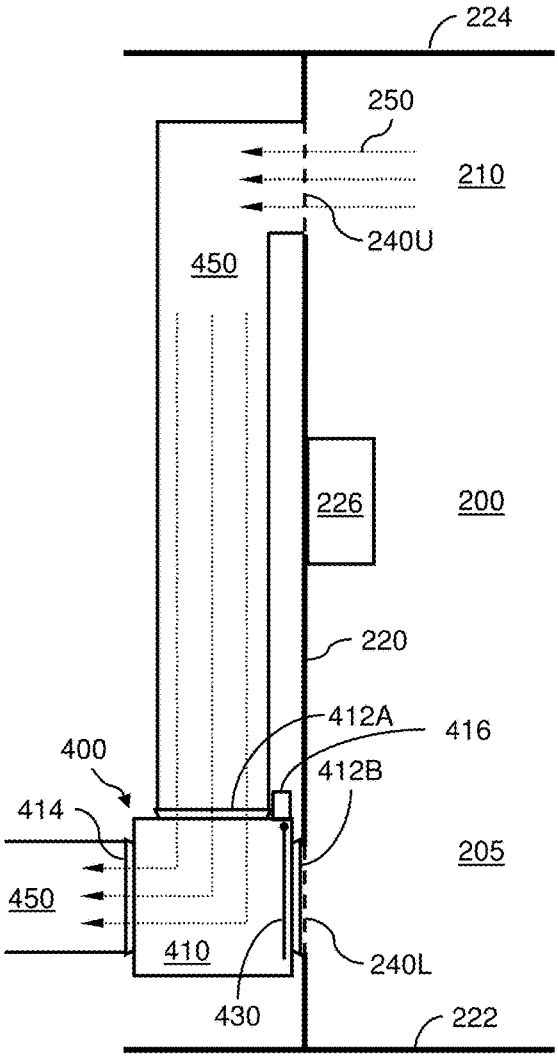
Figure 14B:
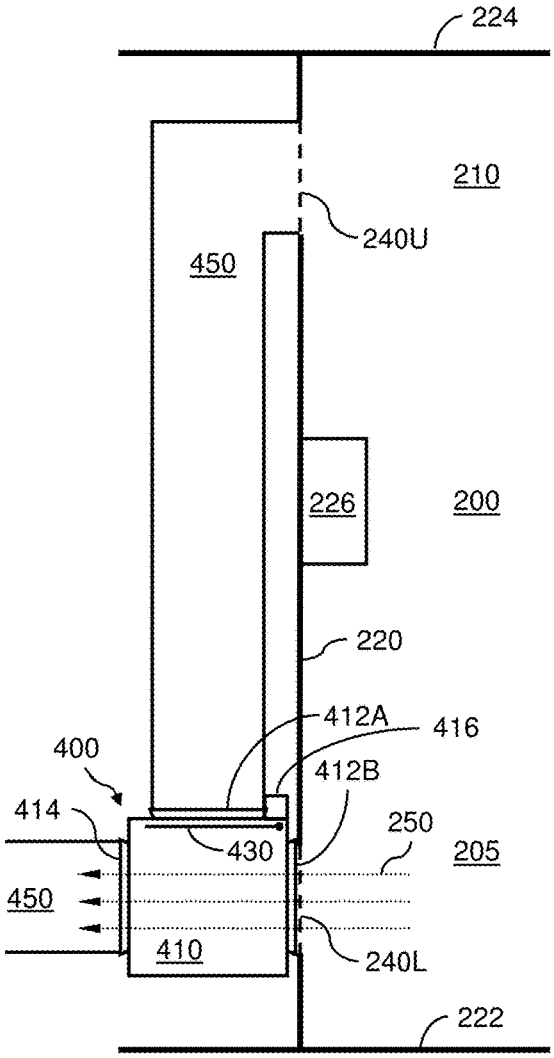

Having thus described the subject matter of the present invention in general terms, reference will now be made to the accompanying drawings, which are not necessarily drawn to scale, and wherein:

FIG. 1, FIG. 2, FIG. 3, FIG. 4, and FIG. 5 illustrate perspective views of examples of an air intake manager for providing optimal operating efficiency in an HVAC system in accordance with example embodiments of the invention;

FIG. 6A illustrates a schematic view of an example of an HVAC system in cooling mode without the air intake manager;

FIG. 6B illustrates a schematic view of an example of an HVAC system in cooling mode with the air intake manager in accordance with an embodiment of the invention;

FIG. 7A illustrates a schematic view of an example of an HVAC system in heating mode without the air intake manager;

FIG. 7B illustrate a schematic view of an example of an HVAC system in heating mode with the air intake manager in accordance with an embodiment of the invention;

FIG. 8A illustrates a schematic view of another example of an HVAC system in heating mode without the air intake manager;

FIG. 8B illustrates a schematic view of another example of an HVAC system in heating mode with the air intake manager in accordance with an embodiment of the invention;

FIG. 8C illustrate another schematic view of the air intake manager of FIG. 8B including an example outlet to return air vent adaptor in accordance with an embodiment of the invention;

FIG. 9A illustrates a schematic view of an example configuration of the air intake manager for selectable operation in cooling mode in accordance with embodiments of the invention;

FIG. 9B illustrates a schematic view of an example configuration of the air intake manager for selectable operation in heating mode in accordance with embodiments of the invention;

FIG. 10A illustrates a schematic view of an example configuration of the air intake manager for selectable operation in heating mode in accordance with embodiments of the invention;

FIG. 10B illustrates a schematic view of an example configuration of the air intake manager for selectable operation in cooling mode in accordance with embodiments of the invention;

FIG. 11A illustrates a schematic view of another example configuration of the air intake manager for selectable operation in heating mode in accordance with embodiments of the invention;

FIG. 11B illustrates a schematic view of another example configuration of the air intake manager for selectable operation in cooling mode in accordance with embodiments of the invention;

FIG. 12 illustrates a flow diagram of an example of a method of using the air intake manager for providing optimal operating efficiency in an HVAC system in accordance with an embodiment of the invention;

FIG. 13A and FIG. 13B illustrate side views of an example of an original construction configuration of the air intake manager in accordance with an embodiment of the invention;

FIG. 14A is a schematic view of an example of an air intake manager shown in FIG. 13A and FIG. 13B installed in the original construction of a room or space in cooling mode in accordance with an embodiment of the invention; and FIG. 14B is a schematic view of an example of the air intake manager shown in FIG. 13A and FIG. 13B installed in the original construction of a room or space in heating mode in accordance with an embodiment of the invention.

DETAILED DESCRIPTION

The subject matter of the present invention now will be described more fully hereinafter with reference to the accompanying drawings, in which some, but not all embodiments of the present invention are shown. Like numbers refer to like elements throughout. The present invention may be embodied in many different forms and should not be construed as limited to the embodiments set forth herein; rather, these embodiments are provided so that this disclosure will satisfy applicable legal requirements. Indeed, many modifications and other embodiments of present invention set forth herein will come to mind to one skilled in the art to which the present invention pertains having the benefit of the teachings presented in the foregoing descriptions and the associated drawings. Therefore, it is to be understood that the present invention is not to be limited to the specific embodiments disclosed and that modifications and other embodiments are intended to be included within the scope of the appended claims.

In some embodiments, the present invention provides a heating, ventilation, and air conditioning (HVAC) system air intake manager and method of using same. In some embodiments, the HVAC system air intake manager may be utilized with forced air systems that provide both heating and air conditioning (i.e., cooling). In other embodiments, the HVAC system air intake manager may be utilized with forced air systems that provide heating only. In yet other embodiments, the HVAC system air intake manager may be utilized with forced air systems that provide air conditioning (i.e., cooling) only.

In one example, original construction return air vents may be found at the base of a wall, which is good for heating because the coolest air in the space to be heated is returned to the HVAC system. However, while return air vents at the base of the wall may be good for heating, it is not good for cooling. This is because, when cooling it is best to return the warmest air in the space to the HVAC system, not the coolest air. In another example, original construction return air vents may be found at the top of the wall, or in the ceiling, which is good for cooling because the warmest air in the space to be cooled is returned to the HVAC system. However, while return air vents at the top of the wall, or in the ceiling, may be good for cooling, it is not good for heating. This is because, when heating it is best to return the coolest air in the space to the HVAC system, not the warmest air.

Accordingly, regardless of the location of the return air vents in the space to be heated or cooled, the presently disclosed HVAC system air intake manager and method provides control such that air returned to the HVAC system is returned from the optimal area (i.e., returned from the warmest area when cooling and/or from the coolest area when heating).

Accordingly, the HVAC system air intake manager and method avoids creating stratified air temperatures, and/or reduces or eliminates stratified air temperatures, improving system operation and improving personal comfort.

Accordingly, the HVAC system air intake manager and method reduces or eliminates over-cooling and/or over-heating of the conditioned air, improving personal comfort.

In some embodiments, the HVAC system air intake manager may provide an air duct or air flow path for directing air from one portion of a room or space to the HVAC return air vent located in another portion of the room or space.

In some embodiments, the HVAC system air intake manager may include an air duct or any type of airflow pathway that includes an inlet at one end and an outlet at the opposite end and wherein the outlet is designed to be fitted to any existing HVAC return air vent.

In some embodiments, the HVAC system air intake manager may provide a mechanism for directing warm air from an upper region (i.e., near the ceiling) of the room or space to an HVAC return air vent located at the lower region (i.e., near the floor in the cool air region) of the room or space. In this example, by returning warm air instead of cool air, the HVAC system air intake manager provides improved performance and efficiency of HVAC systems in the cooling mode of operation.

In some embodiments, the HVAC system air intake manager may provide a mechanism for directing cool air from a lower region (i.e., near the floor) of the room or space to an HVAC return air vent located at the upper region (i.e., near the ceiling in the warm air region) of the room or space. In this example, by returning cool air instead of warm air, the HVAC system air intake manager provides improved performance and efficiency of HVAC systems in the heating mode of operation.

In some embodiments, the HVAC system air intake manager may include mechanisms for selecting the operating mode thereof. In one example, the HVAC system air intake manager may include an upper and a lower inlet and an adjustable baffle for controlling the airflow through either the upper or lower inlet and thereby configure the HVAC system air intake manager to operate in either cooling mode or heating mode.

In some embodiments, the HVAC system air intake manager may be portable, easily assembled and disassembled, and easily fitted to any existing HVAC return air vent.

In some embodiments, the HVAC system air intake manager may be integrated into the HVAC system in the original construction of a room or space. This original construction configuration of the HVAC system air intake manager may include two inlets and an adjustable baffle for directing the airflow from either of the two inlets to an outlet.

Referring now to FIG. 1, FIG. 2, FIG. 3, FIG. 4, and FIG. 5 is perspective views of non-limiting examples of the HVAC system air intake manager 100 for providing optimal operating efficiency in an HVAC system. Air intake manager 100 may include an airflow body 110 that has at least one inlet 112 and an outlet 114. Additionally, a seal (or frame) 116 may be provided at outlet 114. Airflow body 110 is a hollow body and is the main body of air intake manager 100 through which a volume of air may flow. Airflow body 110 may be a single piece unit, or may be in two (2) or more stackable sections 120 for case of assembling, disassembling, moving, and/or accommodating different room/space heights. In the case of multiple stackable sections 120, the multiple stackable sections 120 may each be of the same size (e.g., height), different sizes (e.g., height) from one another, or a combination of same size and differing sizes (e.g., two or more sections of the same size and/or one or more sections of differing sizes).

Airflow body 110 may be any shape or geometry as long as it is sized adequately to handle the CFM rating (Cubic Feet per Minute) of the HVAC system to which it is installed. Further, airflow body 110 may be of any suitable height as may be required for the space to be serviced by the HVAC system and the location of the return air vent(s) and/or height of the ceiling(s).

In the examples shown in FIG. 1, FIG. 2, FIG. 3, FIG. 4, and FIG. 5, airflow body 110 may be of a generally rectangular-shaped hollow body. Airflow body 110 has a height H, a width W, and a depth D. In one non-limiting example, the height H may be in the range of about 84 inches, the width W may be in the range of about 18 inches, and the depth D may be in the range of about 12 inches. In one non-limiting example, for a space having eight (8) foot ceilings and an air return vent at a lower section of a wall, an airflow body 110 having two (2) sections may have a first section (e.g., a lower section) in the range of about three (3) feet high and a second section (e.g., an upper section) in the range of about four (4) feet high. In this example, a one (1) foot gap is left between the top of the airflow body 110 and the ceiling to allow for suitable space to draw air in to the inlet 112.

Figure 1:
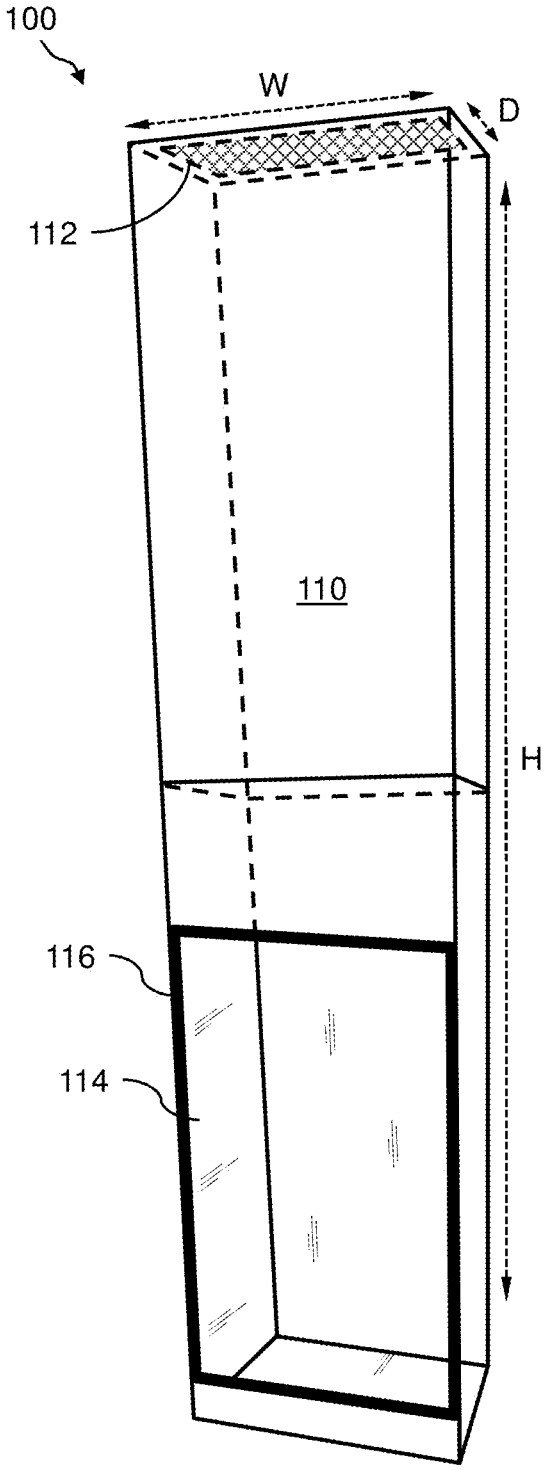

Further, in one example, inlet 112 may be an opening formed at a top end of airflow body 110, as shown in FIG. 1. In another example, inlet 112 may be an opening formed in one or more sides of an upper portion of the airflow body 110, as shown for example in FIG. 2. In yet another example, one inlet 112 may be formed in the top end or one or more sides of an upper portion of the airflow body 110 and another opening in a side of a lower portion of airflow body 110. Additionally, air filters (not shown) may be provided at the openings of outlet 114 and/or inlet 112. In one non-limiting example, the filter may be included right before the outlet 114, where it mates with the HVAC return air vent (e.g., return air vent 230) and/or at inlet 112.

Further, outlet 114 of air intake manager 100 may be sized and shaped to substantially correspond to the size and shape of the return air vent (not shown) of the HVAC system to which it is installed. For example, outlet 114 may be 12×24 inches, 20×20 inches, 14×20 inches, 25×20 inches, 24×48, or any other suitable size as may be required. In some embodiments, outlet 114 of air intake manager 100 may be provided in a certain fixed size and then air intake manager 100 may come with one or more adaptors (e.g. adaptor 118, as shown in FIG. 8C), for translating the fixed size to one or more different sizes.

Figure 2:
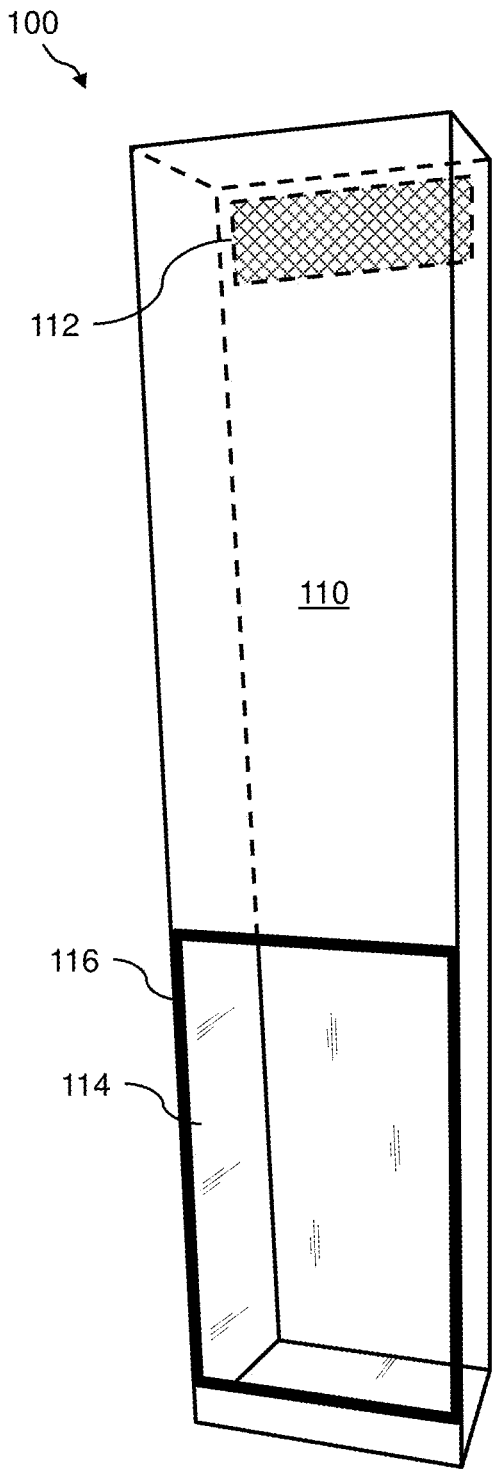

Further, in one example, air intake manager 100 may be provided in one piece, as shown in FIG. 2. In another example, air intake manager 100 may be provided in multiple stackable pieces, as shown for example in FIG. 1 and FIGS. 3-5. In the example shown in FIG. 3, airflow body 110 may have three sections 120 (e.g., 120*a*, 120*b*, 120*c*) that may be stacked together to form the full length of airflow body 110. Any number of sections 120 may be provided to accommodate different heights. Further, in a non-limiting example, the lower section 120*a* may include outlet 114, while the upper section 120*c* may include inlet 112. In an alternative non-limiting example, the upper section 120*c* may include outlet 114, while the lower section 120*a* may include inlet 112. In another alternative non-limiting example, the lower section 120*a* may include an outlet 114 and a first inlet 112, while the upper section 120*c* may include a second inlet 112. In another alternative non-limiting example, the lower section 120*a* may include a first inlet 112, while the upper section 120*c* may include an outlet 114 and a second inlet 112. Additionally, airflow body 110 may be formed of any lightweight, sturdy, and heat tolerant material, such as wood, plastic, aluminum, certain types of fabrics (e.g., PVC fabric), flex duct material, and the like. Optionally, air intake manager 100 may be mounted on wheels (not shown).

Figure 3:
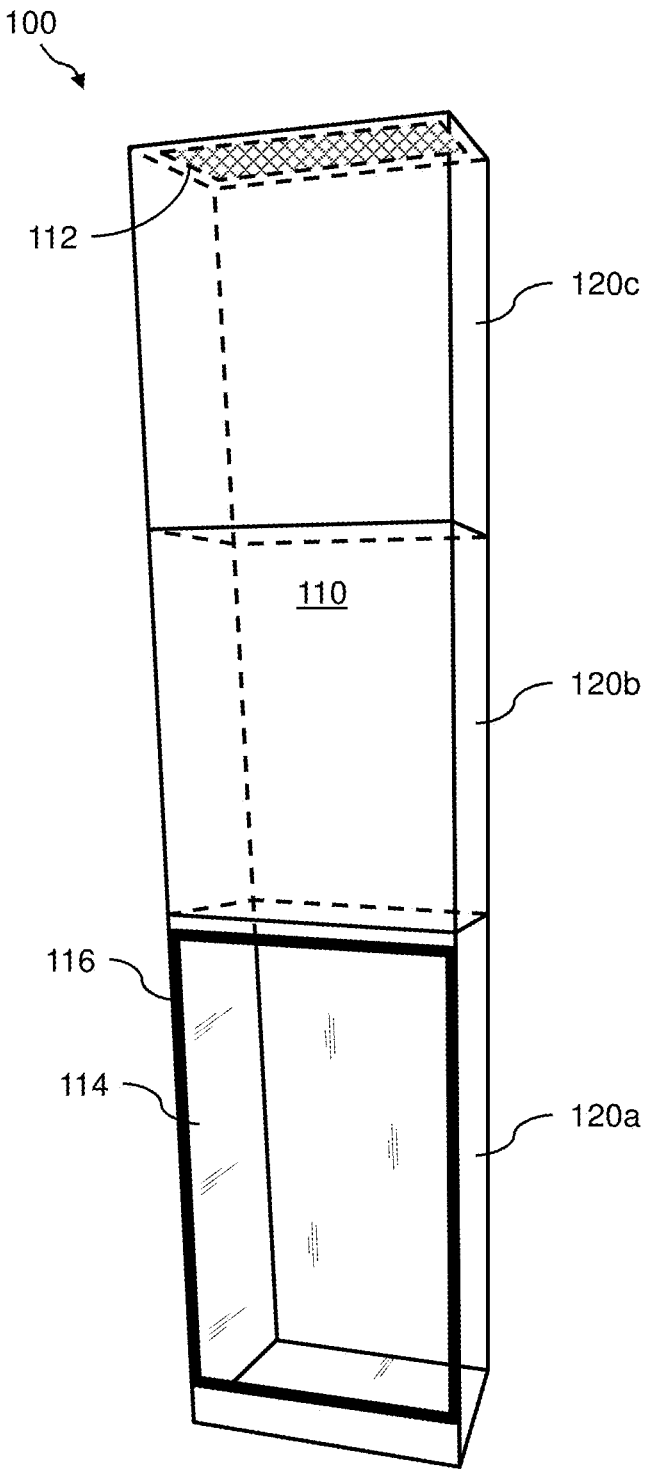
Figure 4:
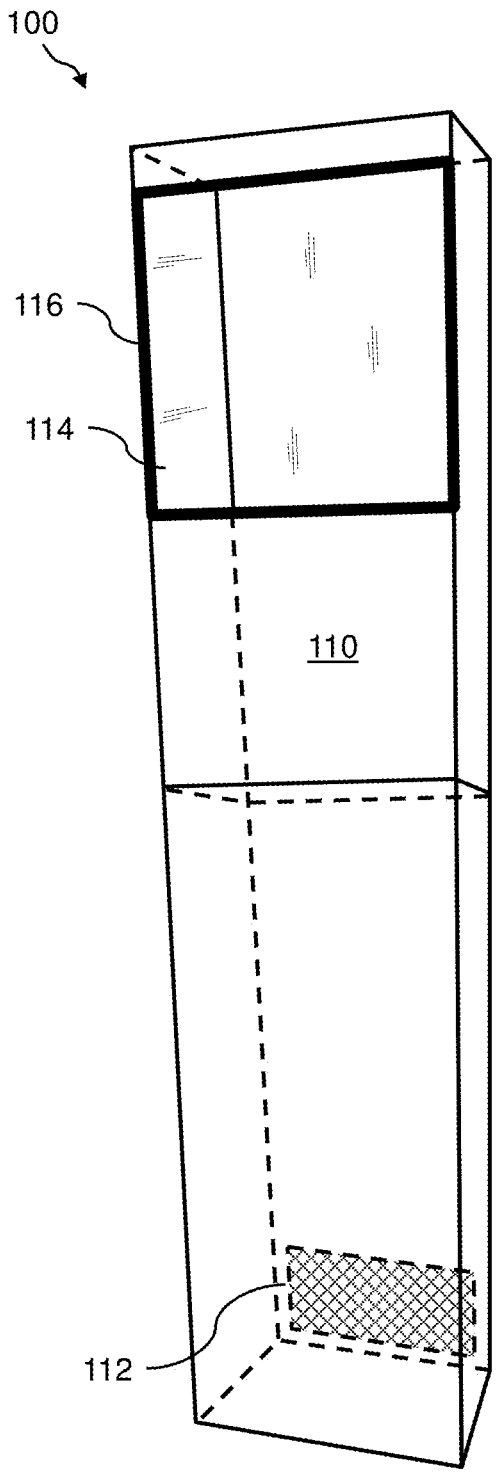
Figure 5:
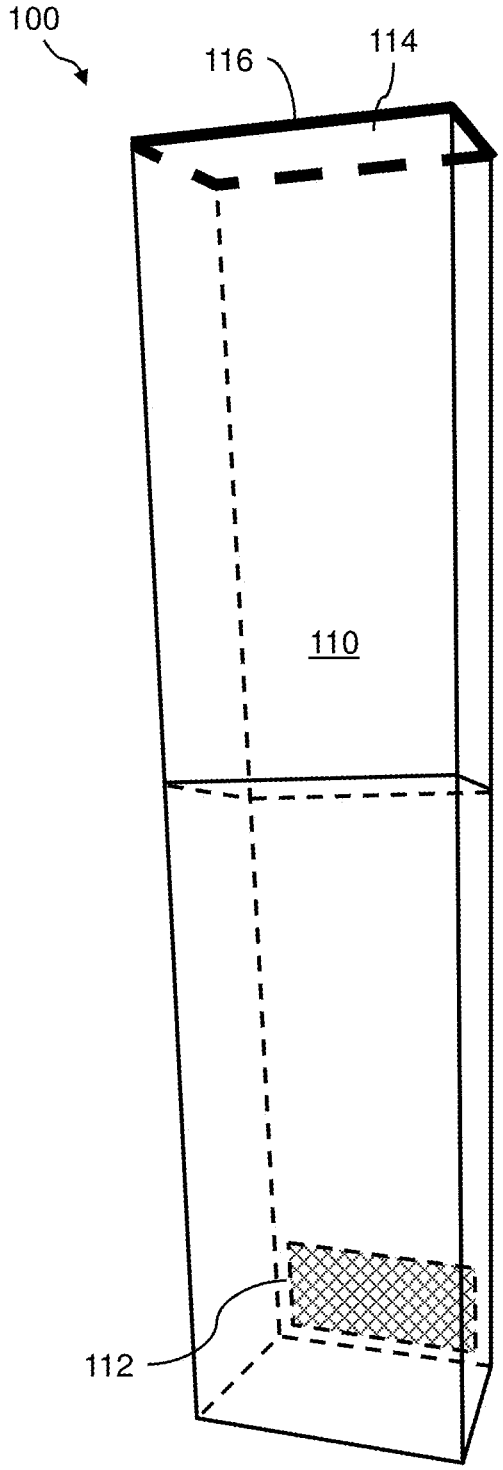

Further, while FIG. 3 shows a way to easily assemble and disassemble air intake manager 100 for convenience of handling, other possibilities exist. For example, airflow body 110 may be flexible and/or collapsible HVAC duct that can be stretched out and supported at both ends. An example, of flexible HVAC duct is the HVAC industrial flexible air ventilation duct formed of PVC fabric available from DEELAT (Miami, FL).

Generally, the HVAC system air intake manager 100 may be provided in any physical configuration as long as it provides an airflow path (e.g., airflow body 110), at least one inlet (e.g., inlet 112) in one portion of the airflow path, and an outlet (e.g., outlet 114) in another portion of the airflow path and wherein the outlet can be mated to the return air vent of an HVAC system. By way of example, FIGS. 6A-11B show schematic views of examples of various configurations of HVAC system air intake manager 100 arranged within a space (or room) 200. Space 200 is an example of a space/room to be serviced by an HVAC system (not shown).

Space 200 may be any of a residential or commercial space or structure, and may have a wall 220, a floor 222, and a ceiling 224. Additionally, space 200 has a space lower region 205 near floor 222 and a space upper region 210 near ceiling 224. A thermostat 226 may be installed on wall 220 about midway of space lower region 205 and space upper region 210. Additionally, a certain return air vent 230 supplies air from space 200 to an HVAC system (not shown).

Referring now to FIG. 6A is an example of an HVAC system operating in cooling mode (or AC mode) in space 200, with return air vent 230 at the bottom of wall 220, and without air intake manager 100 present and installed. In this example, return air vent 230 opens into space lower region 205 of space 200, which is near floor 222. Accordingly, when the HVAC system runs, air 250 from space lower region 205 is drawn into return air vent 230. This configuration has certain drawbacks when the HVAC system is operating in cooling mode (or AC mode). As is well known, cold air sinks and hot air rises. Therefore, because the cold air sinks, the coolest air in the room is in space lower region 205 of space 200. Accordingly, in the configuration shown in FIG. 6A the coolest air in the room is being drawn into return air vent 230 and returned to the HVAC system. However, in cooling mode, the HVAC system operates most efficiently when returning the warmest air in the room, rather than returning the coolest air. Consequently, the configuration shown in FIG. 6A is not ideal for providing optimal operating efficiency in an HVAC system operating in cooling mode.

By contrast, FIG. 6B shows an example of the HVAC system operating in cooling mode (or AC mode) in the same space 200 that has return air vent 230 at the bottom of wall 220, but with air intake manager 100 present and installed. In this example, outlet 114 and seal (or frame) 116 of air intake manager 100 is mated with return air vent 230 and air intake manager 100 extends upward such that inlet 112 is in the upper region 210 of space 200. Because hot air rises, the warmest air in the room is in the upper region 210 of space 200. Accordingly, air intake manager 100 may be used to direct the warmest air in the room (in place of the coolest air in FIG. 6A) into return air vent 230 of the HVAC system. In cooling mode, because the HVAC system operates most efficiently when returning the warmest air in the room, the configuration of air intake manager 100 shown in FIG. 6B helps provide optimal operating efficiency in an HVAC system, and provides more uniform cooling of space 200.

Referring now to FIG. 7A is an example of an HVAC system operating in heating mode in space 200, with return air vent 230 at the top of wall 220, and without air intake manager 100 present and installed. In this example, return air vent 230 opens into the upper region 210 of space 200, which is near ceiling 224. Accordingly, when the HVAC system runs, air 250 from the upper region 210 is drawn into return air vent 230. This configuration has certain drawbacks when the HVAC system is operating in heating mode. Because the hot air rises, the warmest air in the room is in the upper region 210 of space 200. Accordingly, the warmest air in the room is being drawn into return air vent 230 and returned to the HVAC system. However, in heating mode, the HVAC system operates most efficiently when returning the coldest air in the room, rather than returning the warmest air. Consequently, the configuration shown in FIG. 7A is not ideal for providing optimal operating efficiency in an HVAC system operating in heating mode.

By contrast, FIG. 7B shows an example of the HVAC system operating in heating mode in the same space 200 that has return air vent 230 at the top of wall 220, but with air intake manager 100 present and installed. In this example, air intake manager 100 is configured with inlet 112 at the bottom and outlet 114 and seal (or frame) 116 at the top. Accordingly, outlet 114 and seal (or frame) 116 of air intake manager 100 may be mated with return air vent 230 and air intake manager 100 extends downward such that inlet 112 is in the lower region 205 of space 200. Because the cold air sinks, the coolest air in the room is in the lower region 205 of space 200. Accordingly, air intake manager 100 may be used to direct the coolest air in the room (in place of the warmest air in FIG. 7A) into return air vent 230 of the HVAC system. In heating mode, because the HVAC system operates most efficiently when returning the coolest air in the room, the configuration of air intake manager 100 shown in FIG. 7B helps provide optimal operating efficiency in an HVAC system, and provides more uniform heating of space 200.

Referring now to FIG. 8A is an example of an HVAC system operating in heating mode in space 200, with return air vent 230 in ceiling 224, and without air intake manager 100 present and installed. This example is substantially the same as shown in FIG. 7A, except that return air vent 230 is located in ceiling 224 instead of wall 220. However, return air vent 230 still opens into space upper region 210 of space 200, which is near ceiling 224. As described in FIG. 7A, because is it returning the warmest air in the room instead of the coolest air in the room, the configuration shown here in FIG. 8A is not ideal for providing optimal operating efficiency in an HVAC system operating in heating mode.

By contrast, FIG. 8B shows an example of the HVAC system operating in heating in the same space 200 that has return air vent 230 in ceiling 224, but with air intake manager 100 present and installed. In this example, air intake manager 100 is configured with its outlet 114 and seal (or frame) 116 facing upward toward ceiling 224 so that it can be mated with return air vent 230. This example is substantially the same as shown in FIG. 7B because, air intake manager 100 extends downward such that inlet 112 is in the lower region 205 of space 200 and is returning the coolest air in the room to the HVAC system. Again, in heating mode and as described in FIG. 7B, because the HVAC system operates most efficiently when returning the coolest air in the room, the configuration of air intake manager 100 shown in FIG. 8B helps provide optimal operating efficiency in an HVAC system, and provides more uniform heating of space 200.

Further, the configurations of air intake manager 100 shown in FIG. 6B, FIG. 7B, and FIG. 8B may be used to avoid creating stratified air temperatures, and/or to reduce or eliminate stratified air temperatures in space 200, improving system operation and improving personal comfort. Additionally, the configuration of air intake manager 100 shown in FIG. 6B, FIG. 7B, and FIG. 8B may be used to reduce or eliminate over-cooling and/or over-heating of the conditioned air in space 200, improving personal comfort.

FIG. 6B shows an example configuration of air intake manager 100 for dedicated operation in cooling mode (or AC mode). FIG. 7B, FIGS. 8B, and 8C show example configurations of air intake manager 100 for dedicated operation in heating mode. However, other configurations of air intake manager 100 are possible in which the operating mode may be selectable. For example, FIG. 9A, FIG. 9B, FIG. 10A, FIG. 10B, FIG. 11A, and FIG. 11B show schematic views of examples of configurations of the presently disclosed air intake manager 100 for selectable operation in either cooling or heating mode.

Referring now to FIG. 9A and FIG. 9B, air intake manager 100 may include an upper inlet 112U and a lower inlet 112L. Upper inlet 112U may be located in space upper region 210 of space 200 while lower inlet 112L may be located in space lower region 205 of space 200. Additionally, air intake manager 100 may include an adjustable baffle, such as hinged baffle 130. Hinged baffle may be positioned at lower inlet 112L. Air intake manager 100 shown in FIG. 9A and FIG. 9B is substantially the same as the configuration of air intake manager 100 shown in FIG. 6B except for the addition of lower inlet 112L and hinged baffle 130 at lower inlet 112L for selectively blocking airflow from one of upper inlet 112U or lower inlet 112L. Further, in this example, return air vent 230 of the HVAC system may be located at the bottom portion of wall 220.

Hinged baffle 130 may be any of a baffle, flap, louver, damper, or other suitable mechanism that may be installed in airflow body 110 and that may be used to control the airflow within air intake manager 100. For example, in one position, as shown for example in FIG. 9A, hinged baffle 130 is set to block the airway between lower inlet 112L and outlet 114 and to open the airway between upper inlet 112U and outlet 114, wherein outlet 114 supplies return air vent 230. This position of hinged baffle 130 is set for operating in cooling mode (or AC mode).

However, in another position, as shown for example in FIG. 9B, hinged baffle 130 is set to block the airway between upper inlet 112U and outlet 114 and to open the airway between lower inlet 112L and outlet 114, wherein outlet 114 supplies return air vent 230. This position of hinged baffle 130 is set for operating in heating mode. In one example, the state of hinged baffle 130 may be set manually with a handle, knob, lever, or other suitable mechanism (not shown). In another example, the state of hinged baffle 130 may be set automatically based on a state of operation of the HVAC system. For example, when the HVAC system is in "cooling" mode, the hinged baffle 130 may automatically set as shown in FIG. 9A, which is blocking lower inlet 112L and opening upper inlet 112U. By contrast, when the HVAC system is in "heating" mode, the hinged baffle 130 may automatically set as shown in FIG. 9B, which is blocking upper inlet 112U and opening lower inlet 112L. In one non-limiting example hinged baffle 130 may be set in place, for example, via a motor or other similar electro-mechanical device (not shown), and may be controlled by a controller (e.g., controller 416 shown for example in FIGS. 14A and 14B).

Referring now to FIG. 10A and FIG. 10B, air intake manager 100 may include upper inlet 112U and lower inlet 112L. Upper inlet 112U may be located in the upper region 210 of space 200 while lower inlet 112L may be located in the lower region 205 of space 200. Additionally, air intake manager 100 may include hinged baffle 130 at upper inlet 112U. Air intake manager 100 shown in FIG. 10A and FIG. 10B is substantially the same as the configuration of air intake manager 100 shown in FIG. 7B except for the addition of upper inlet 112U and hinged baffle 130 at upper inlet 112U for controlling the operating mode. Further, in this example, return air vent 230 of the HVAC system may be at the top of wall 220.

Again, hinged baffle 130 may be used to control the airflow in air intake manager 100. For example, in one position, as shown in FIG. 10A, hinged baffle 130 is set to block the airway between upper inlet 112U and outlet 114 and to open the airway between lower inlet 112L and outlet 114, wherein outlet 114 supplies return air vent 230. This position of hinged baffle 130 is set for operating in heating mode.

However, in another position, as shown in FIG. 10B, hinged baffle 130 is set to block the airway between lower inlet 112L and outlet 114 and to open the airway between upper inlet 112U and outlet 114, wherein outlet 114 supplies return air vent 230. This position of hinged baffle 130 is set for operating in cooling (or AC mode) mode. In one example, the state of hinged baffle 130 may be set manually with a handle, knob, lever, or other suitable mechanism (not shown). In another example, the state of hinged baffle 130 may be set automatically based on a state of operation of the HVAC system.

For example, when the HVAC system is in "heating" mode, hinged baffle 130 automatically sets as shown in FIG. 10A, which is blocking upper inlet 112U and opening lower inlet 112L. By contrast, when the HVAC system is in "cooling" mode, hinged baffle 130 automatically sets as shown in FIG. 10B, which is blocking lower inlet 112L and opening upper inlet 112U. In one non-limiting example hinged baffle 130 may be set in place, for example, via a motor or other similar electro-mechanical device (not shown), and may be controlled by a controller (e.g., controller 416 shown for example in FIGS. 14A and 14B).

Referring now to FIG. 11A and FIG. 11B, air intake manager 100 may include upper inlet 112U and lower inlet 112L. Upper inlet 112U may be located in upper region 210 of space 200 while lower inlet 112L may be located in lower region 205 of space 200. Additionally, air intake manager 100 may include hinged baffle 130 at upper inlet 112U. Air intake manager 100 shown in FIG. 11A and FIG. 11B is substantially the same as the configuration of air intake manager 100 shown in FIG. 8B except for the addition of upper inlet 112U and hinged baffle 130 at upper inlet 112U for controlling the operating mode. Further, in this example, return air vent 230 of the HVAC system may be at the ceiling 224.

Again, hinged baffle 130 may be used to control the airflow in air intake manager 100. For example, in one position, as shown in FIG. 11A, hinged baffle 130 is set to block the airway between upper inlet 112U and outlet 114 and to open the airway between lower inlet 112L and outlet 114, wherein outlet 114 supplies return air vent 230. This position of hinged baffle 130 is set for operating in heating mode.

However, in another position, as shown in FIG. 11B, hinged baffle 130 is set to block the airway between lower inlet 112L and outlet 114 and to open the airway between upper inlet 112U and outlet 114, wherein outlet 114 supplies return air vent 230. This position of hinged baffle 130 is set for operating in cooling (or AC mode) mode. In one example, the state of hinged baffle 130 may be set manually with a handle, knob, lever or other suitable mechanism (not shown). In another example, the state of hinged baffle 130 may be set automatically based on a state of operation of the HVAC system. For example, when the HVAC system is in "heating" mode, hinged baffle 130 automatically sets as shown in FIG. 11A, which is blocking upper inlet 112U and opening lower inlet 112L. By contrast, when the HVAC system is in "cooling" mode, hinged baffle 130 automatically sets as shown in FIG. 11B, which is blocking lower inlet 112L and opening upper inlet 112U. In one non-limiting example hinged baffle 130 may be set in place, for example, via a motor or other similar electro-mechanical device (not shown), and may be controlled by a controller (e.g., controller 416 shown for example in FIGS. 14A and 14B).

Further, the configurations of air intake manager 100 shown in FIG. 9A, FIG. 9B, FIG. 10A, FIG. 10B, FIG. 11A, and FIG. 11B may be used to improving system operation and improving personal comfort. Additionally, the configuration of air intake manager 100 shown in FIG. 9A, FIG. 9B, FIG. 10A, FIG. 10B, FIG. 11A, and FIG. 11B may be used to reduce or eliminate over-cooling and/or over-heating of the conditioned air in space 200, improving personal comfort.

Referring now to FIG. 12 is a flow diagram of an example of a method 300 of using the presently disclosed HVAC system air intake manager 100 for providing optimal operating efficiency in an HVAC system. Method 300 may include, but is not limited to, the following steps.

At a step 310, the applicable embodiment of HVAC system air intake manager 100 is provided in the space 200 to be heated and/or cooled.

At a step 315, the outlet of the presently disclosed HVAC system air intake manager 100 is positioned with respect to the return air vent of the HVAC system. For example, outlet 114 of air intake manager 100 is mated with return air vent 230 of the HVAC system.

At a step 320, the HVAC system may be activated. In one example, the HVAC system may be activated in cooling mode and the presence of air intake manager 100 allows the warmest air in the room to be returned (instead of the coolest air in the absence of air intake manager 100). As a result, the HVAC system can operate in cooling mode in a highly efficient manner due to the presence of air intake manager 100.

In another example, the HVAC system may be activated in heating mode and the presence of air intake manager 100 allows the coolest air in the room to be returned (instead of the warmest air in the absence of air intake manager 100). As a result, the HVAC system can operate in heating mode in a highly efficient manner due to the presence of air intake manager 100.

The examples of air intake manager 100 shown and described hereinabove with reference to FIG. 1 through FIG. 11B are configurations for using air intake manager 100 as, for example, an add-on item to an existing (already installed) HVAC system. However, the presently disclosed air intake manager is not limited to being an add-on item to an existing (already installed) HVAC system. In other embodiments, an air intake manager (air intake manager 400) may be provided in the original construction of a building or space, as shown, for example, hereinbelow with reference to FIG. 13A through FIG. 14B.

Referring now to FIG. 13A and FIG. 13B are side views of an air intake manager 400, which is an example of an original construction or reconstruction configuration of the subject air intake manager. For example, air intake manager 400 may be integrated into the HVAC system in the original construction or reconstruction of a structure, such as a building or room. An example of air intake manager 400 installed in the original construction or reconstruction of a structure including a space 200 is shown and described hereinbelow with reference to FIG. 14A and FIG. 14B.

Air intake manager 400 may include an airflow body 410, which may be, for example, a hollow metal box like structure. Air intake manager 400, may include one or more input ports (preferably two input ports), and an output port. For example, an input port 412A may be provided in a top portion of airflow body 410. Further, an input port 412B may be provided in a side portion of airflow body 410. Further, an output port 414 may be provided in a side portion of airflow body 410 different than that of input port 412B. However, this configuration of two input ports and one output port is exemplary only. Input ports and output ports may be arranged on any surfaces of airflow body 410.

Additionally, air intake manager 400 may include a baffle, such as hinged baffle 430, arranged with respect to input port 412A and input port 412B. Hinged baffle 430 may be a baffle, flap, louver, damper, or other suitable mechanism that may be installed with respect to airflow body 410 and that may be used to control the airflow within air intake manager 400. For example, in one position, as shown in FIG. 13A, hinged baffle 430 may be set to block input port 412A and to open input port 412B. In this example, an airway is provided between input port 412B and output port 414. In another position, as shown in FIG. 13B, hinged baffle 430 may be set to block input port 412B and to open input port 412A. In this example, an airway is provided between input port 412A and output port 414. In one example, baffle 430 may be set manually with a handle, knob, lever, or other suitable mechanism (not shown). In another example, the state of hinged baffle 430 may be set automatically based on a state of operation of the HVAC system. In such an example, hinged baffle 430 may be controlled by a controller 416. The position of hinged baffle 430 may be adjusted by a motor or other similar electro-mechanical device, and may be controlled by the controller 416. Controller 416 may be an electromechanical controller, and in communication with the HVAC system. Controller 416 may be in electrical and/or wireless communication with the HVAC system, such that it receives a signal from, or senses the state of operation of, the HVAC system. Based on the received signal or sensed state of operation of the HVAC system, the controller 416 sets baffle 430 to its corresponding position. In one example, the controller 416 activates a motor or other similar electro-mechanical device to set the position of the baffle 430.

Referring now to FIG. 14A and FIG. 14B is schematic views of an example of air intake manager 400 shown in FIG. 13A and FIG. 13B installed in the original construction of a structure, such as a building or room. For example, air intake manager 400 may be installed in the original construction of a structure that includes the space 200. In this example, air intake manager 400 may be installed behind a wall 220 during the original construction of the structure that includes the space 200. Additionally, in one example, wall 220 may have an upper return air vent 240U and a lower return air vent 240L. In this example, upper return air vent 240U supplies input port 412A of air intake manager 400 via, for example a duct 450, lower return air vent 240L may supply input port 412B of air intake manager 400 directly, and output port 414 of air intake manager 400 supplies returned air from the selected one of input port 412A or 412B to the HVAC system, for example via another duct 450.

In cooling mode (or AC mode) as shown in FIG. 14A, hinged baffle 430 may be set to block lower return air vent 240L and to open the airway leading to upper return air vent 240U. This setting of air intake manager 400 allows the warmest air in the room, which is near ceiling 224, to be returned to the HVAC system. In heating mode as shown in FIG. 14B, hinged baffle 430 may be set to block the airway leading to upper return air vent 240U and to open lower return air vent 240L. This setting of air intake manager 400 allows the coolest air in the room, which is near floor 222, to be returned to the HVAC system.

In one example, the state of hinged baffle 430 may be set manually with a handle, knob, lever, or other suitable mechanism not shown. In another example, the state of hinged baffle 430 may be set automatically via controller 416 based on a state of operation of the HVAC system. For example, when HVAC system is in "cooling" mode, hinged baffle 430 automatically sets as shown in FIG. 14A, which is blocking lower return air vent 240L and opening upper return air vent 240U. By contrast, when HVAC system is in "heating" mode, hinged baffle 430 automatically sets as shown in FIG. 14B which is blocking upper return air vent 240U and opening lower return air vent 240L. In one example, the position of hinged baffle 430 may be adjusted by a motor or other similar electro-mechanical device, and may be controlled by the controller 416.

Referring now again to FIG. 1 through FIG. 14B, the benefits of the HVAC system air intake manager 100, 400 and method 300 may include, but are not limited to, the following:

Air intake manager 100, 400 avoids creating stratified air temperatures, and/or reduces or eliminates stratified air temperatures, improving system operation and improving personal comfort.

Air intake manager 100,400 reduces or eliminates over-cooling and/or over-heating of the conditioned air, improving personal comfort.

Air intake manager 100 may be added (permanently or seasonally) to existing home air conditioning systems, where compatible.

Air intake manager 100 may be installed and removed by the homeowner.

Air intake manager 100, 400 enables existing HVAC system to reach desired temperature more quickly in both cooling mode and heating mode.

Air intake manager 100, 400 enables HVAC system to turn off sooner in both cooling mode and heating mode.

Air intake manager 100, 400 enables HVAC system to stay off longer in both cooling mode and heating mode.

Air intake manager 100, 400 reduces HVAC system total run-time.

Air intake manager 100, 400 reduces HVAC system operation expense.

Air intake manager 100, 400 provides more uniform cooling or heating of an area.

Air intake manager 100, 400 provides more comfort and satisfaction to persons.

Air intake manager 100, 400 reduces strain on the climate.

Air intake manager 100, 400 due to the realized efficiencies, may potentially reduce the size of the HVAC system required to adequately service the space 200.

EXAMPLE

In the configuration that corresponds to that shown in FIG. 6A with no air intake manager 100 present and installed, certain analysis was performed in a one story, single family house. In this test case the HVAC system return air vent was located low on the wall.

First a laser temperature reader was utilized to measure the temperature in each room at four heights: 2, 4, 6 and 8 feet above the floor. Readings were taken at the thermostat location and at other locations in the house. Readings were taken first thing in the morning, when the HVAC system had not run overnight because there was no demand for it by the thermostat. Readings were also taken when the HVAC system was first called to provide service (in AC or cooling mode), and at points as it was running. This provided insights into the process of actually cooling the house.

Temperature readings taken first thing in the morning, when the HVAC system had been inactive for several hours, presented a view of the static, equilibrium system state. During the prior evening and early night hours the HVAC system had been cooling the living area. Overnight, temperatures were often cool enough that no further cooling was necessary and the system did not become active. House temperatures were at, or slightly below, the thermostat temperature setting.

Morning temperature readings, taken with the laser reader, provided a further insight. At all four reading levels (i.e., 2, 4, 6, and 8 feet) temperatures were equal or nearly equal. Later in the morning, and during the day, when the outside temperature began rising and temperatures in the house began rising, the HVAC system would activate automatically.

Temperature readings taken with the laser reader during the day would display timely cooling to almost the requested temperature. However, it seemed difficult for the system to get completely to the requested temperature so that the AC system would shut off. Temperature readings were cooler at the bottom of the wall, and hotter than the desired setting at the top of the wall. The difference could be as much as 6 or 8 degrees, with cooler than requested air below thermostat level and warmer than requested air above thermostat level. Most significantly, the temperature at thermostat level was about the desired temperature, but not quite enough to satisfy the setting and turn off the AC system. Eventually, slowly, it would achieve the last degree or two to meet the requested setting, and shut down the AC. Thereafter, the HVAC system cycled on and off frequently for the rest of the day.

What produced the results observed? Of course, hot air rises and cold air sinks, which explains why the air is hotter at the top and cooler at the bottom of the wall. But why does the air begin the day at a common temperature from bottom to top, but become stratified by use of the AC system? Further consideration, reveals the following:

The return air vent (in this installation) is in the wall, at floor level, so the AC system, trying to cool the room, is taking in the coldest air in the room—from the floor level—cooling it further, and returning it to the room. At the beginning of the day all room air is about the same, warm temperature, and being drawn into the AC system.

The cooling vents, delivering cold air from the AC equipment, in this installation, are located on the floor. This delivers cold air into the cold air previously delivered, near the floor. It does not easily or quickly mix with the warm air at the top, creating the stratified air.

Next, in the configuration that corresponds to that shown in FIG. 6B, air intake manager 100 was placed in front of the return air vent. That is, outlet 114 of air intake manager 100 was fitted against the return air vent. This drew air from the top of the room into the HVAC return air vent at the bottom of the wall. It was not secured and was not airtight. But most of the air being returned to the AC equipment was believed to be coming through air intake manager 100.

Air intake manager 100 was left in place and observed for a few days.

Temperature readings were taken as before. The following observations were made:

(1) The thermostat reached the desired temperature faster than previously observed;

(2) The temperature readings from all levels, from bottom to top, had less variation and stratification;

(3) The thermostat turned the AC system off sooner; and (4) The AC system stayed off longer before being called again.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A method of using an apparatus for managing return air intake in a heating, ventilation, and air conditioning (HVAC) system, the method comprising:

a. providing an apparatus for managing return air intake in the HVAC system, comprising:

i. a free-standing self-contained substantially hollow airflow body formed by a front wall, a rear wall, and two opposing side walls positioned between the front and rear walls, the airflow body configured to stand outside of an existing wall structure;

ii. a first return air inlet formed in a first portion of the airflow body and a second return air inlet formed in a second portion of the airflow body, wherein the first return air inlet is configured to intake air from an upper region of a space being serviced by the HVAC system when the HVAC system is in a cooling mode and the second return air inlet is configured to intake air from a lower region of the space being serviced by the HVAC system when the HVAC system is in a heating mode;

iii. a return air outlet formed in a third portion of the airflow body, wherein the first return air inlet and the second return air inlet are configured to be in selective fluid communication with the return air outlet through at least a portion of the airflow body, and wherein the return air outlet is configured to align and engage in fluid communication with an existing return air vent within a ceiling or wall structure of the HVAC system in a space in which the apparatus is installed;

iv. a hinged baffle connected to an interior portion of the airflow body, wherein the hinged baffle is configured to be selectively moved between a first position and a second position and to block fluid communication between one of the first return air inlet or the second return air inlet and the return air outlet and to allow fluid communication between the other of the first return air inlet or the second return air inlet and the return air outlet; and v. a controller, wherein the controller is in communication with the HVAC system and is configured to control the position of the hinged baffle between the first position and the second position based on a state of operation of the HVAC system;

b. positioning the air intake management apparatus in the space to be serviced by the HVAC system such that the return air outlet is in fluid communication with the existing return air vent of the HVAC system; and c. activating the HVAC system;

d. sensing the state of operation of the HVAC system by the controller, wherein upon sensing the state of operation of the HVAC system positioning the position of the hinged baffle via the controller such that air from an upper region of the space being serviced by the HVAC system is pulled in through the first return air inlet when the HVAC system is in the cooling mode and is pulled in through the second return air inlet when the HVAC system is in a heating mode.

2. The method of claim 1, further comprising one or more adaptors configured to allow the return air outlet to engage in fluid communication with the existing return air vent of the HVAC system.

3. The method of claim 1, wherein the position of the hinged baffle is configured to be set automatically upon sensing the state of operation of the HVAC system.

4. The method of claim 1, wherein the airflow body comprises a plurality of stackable sections.

5. The method of claim 1, wherein the airflow body comprises one or more of a rigid, semi-rigid, flexible, and collapsible material.

6. The method of claim 1, wherein the airflow body comprises one of a rectangular, ovular, or circular cross-sectional shape.

7. The method of claim 1, wherein the airflow body is configured to be portable.

8. The method of claim 1, wherein the first return air inlet is formed in a top end, the front wall, or either or both of the side walls of the first portion of the airflow body and the second return air inlet is formed in the front wall or either or both of the side walls of the second portion of the airflow body.

* * * * *